US006359245B1

(12) United States Patent
Wahls

(10) Patent No.: US 6,359,245 B1
(45) Date of Patent: Mar. 19, 2002

(54) TRACTOR SEAT SAFETY SYSTEM

(75) Inventor: Robert J. Wahls, Pinckney, MI (US)

(73) Assignee: Michigan Seat Company, Jackson, MI (US)

( * ) Notice: Subject to any disclaimer, the term of this patent is extended or adjusted under 35 U.S.C. 154(b) by 0 days.

(21) Appl. No.: 09/690,862

(22) Filed: Oct. 18, 2000

(51) Int. Cl.[7] ..... H01H 35/00

(52) U.S. Cl. ..... 200/52 R; 200/85 A; 200/332; 180/273

(58) Field of Search ..... 200/85 A, 332, 200/332.1, 172, 330, 47, 86.5; 180/273, 290

(56) References Cited

U.S. PATENT DOCUMENTS 3,155,807 A * 11/1964 Wiley ..... 200/172
4,295,017 A * 10/1981 Kashima et al. ..... 200/47
4,362,741 A * 12/1982 Leskoverc et al. ..... 200/85 A
4,385,863 A 5/1983 Minor
4,455,466 A * 6/1984 Wilson ..... 200/86.5
4,678,058 A * 7/1987 Wooters ..... 180/273
4,795,865 A * 1/1989 Howard ..... 200/85 A
5,124,512 A 6/1992 Huettner et al.
5,146,054 A 9/1992 Etters
5,162,626 A 11/1992 Hutchison et al.
5,424,502 A 6/1995 Williams
5,502,284 A 3/1996 Meiller et al.

* cited by examiner

*Primary Examiner*—Lincoln Donovan
*Assistant Examiner*—Kyung S. Lee
(74) *Attorney, Agent, or Firm*—Young & Basile, P.C.

(57) ABSTRACT

A vehicle seat safety system using an electric seat mounted switch sensing the operator's presence in the seat. The electric switch includes an upwardly extending actuator and an actuator plate is superimposed over the switch actuator which is deflected downwardly by the vehicle operator's weight. The actuator plate is formed of an upwardly bowed resilient material and includes lateral extensions whereby the safety switch will sense the operator's weight even though the operator's center of gravity is significantly laterally shifted. Additionally, the switch is received within a uniquely configured opening whereby the switch may be easily replaced, or installed, from the lower side of the seat without disassembly of the upper seat components.

7 Claims, 2 Drawing Sheets

TRACTOR SEAT SAFETY SYSTEM

BACKGROUND OF THE INVENTION

1. Field of the Invention

The invention pertains to vehicle safety systems sensing the operator's weight upon the vehicle seat and is characterized by its simplicity of construction, ease of assembly and disassembly, and ability to sense a shifting of the operator's weight upon the seat.

2. Description of the Related Art

A number of vehicle safety systems utilize an electric switch which senses the operator's presence upon the vehicle seat whereby desired vehicle functions can be rendered inoperative if the operator is not seated.

Such vehicle safety systems may include a switch mounted in the central region of the seat lower panel, or a switch sensing the position of the seat support structure, and includes an upwardly extending or moving switch actuator which is depressed by the operator's weight and is released when the operator's weight is removed from the actuator. One of the problems encountered with this type of switch controlled vehicle safety systems arises from the fact that if the operator's weight laterally shifts on the seat, the electric switch may operate even though the operator is located on the seat and desires normal vehicle operation. Such inadvertent safety switch operation due to the operator's weight shifting on the seat is troublesome, inconvenient and may raise safety concerns.

Another problem that arises with vehicle seat safety systems utilizing electric switches mounted in the lower panel of a vehicle seat results from difficulty in assembling the electric switch into the seat, or removing the electric switch for maintenance and replacement purposes. Vehicle seats usually include foam cushions or covers integrally attached to the seat pan and back, and it is difficult to directly incorporate the electric switch into the seat structure in such a manner as to permit easy switch installation and removal. Accordingly, in many vehicle safety systems utilizing electric switches operated by the operator weight, the switch is located exteriorly of the seat necessitating a vertically movable seat support, which may not be desirable.

OBJECTS OF THE INVENTION

It is an object of the invention to provide a vehicle seat safety system for use with cushioned vehicle seats which employs an electric switch mounted within the seat bottom or lower panel, and wherein the electric switch will sense the operator's weight even though such weight is laterally displaced upon the seat.

Another object of the invention is to provide a vehicle seat safety system wherein an electric switch is directly mounted in the seat lower panel and may be inserted into the seat panel, and removed therefrom, from the lower side of the seat panel without necessitating special tools or disassembly of the seat, and yet the electric switch will be positively maintained in the desired operative position.

SUMMARY OF THE INVENTION

The vehicle safety system in accord with the invention is associated with the lower panel of the seat pan and may be utilized with vehicle seats of various configurations with or without back rests.

The seat bottom consists of a lower panel, usually stamped of metal, and a foam cushion is supported by the lower seat panel. The seat lower panel includes upper and lower sides, as well as a central region, lateral sides and a forward and rear region.

An opening is defined in the seat lower panel central region equally spaced between the panel lower sides, and an electric switch having an upwardly extending actuator located upon the switch is mounted within the panel opening. Vertical movement of the actuator operates the switch.

An actuator plate is superimposed over a significant portion of the upper side of the seat lower panel central region, and over the switch actuator. Preferably, the actuator plate is formed of a resilient material, such as spring steel, and is bowed upwardly so that the portion superimposed over the switch actuator is normally out of engagement with the actuator, and the actuator plate includes a forward edge disposed toward the lower seat panel forward region, and the actuator plate also includes a rear edge disposed toward the seat panel rear region. The rear edge of the actuator plate is formed with a pair of hinged projections which are received within openings defined in the seat lower panel forming a hinge for the actuator plate and maintaining the actuator plate in its desired position over the electric switch and its actuator.

The actuator plate is located below the flexible seat cushion wherein weight on the seat cushion depresses the actuator plate operating the switch actuator. In order that the electric switch will always sense the presence of the operator's weight, extensions are defined on the lateral sides of the actuator plate extending toward the seat lower panel lateral sides. These actuator plate extensions render the actuator plate sensitive to the operator's lateral movement upon the seat permitting the switch to sense the operator's presence upon the seat even though the operator's weight significantly shifts laterally on the seat for whatever reason.

The opening for receiving the electric switch located within the central region of the seat lower panel is of a general "keyhole" configuration, i.e. includes a larger portion intersecting an elongated smaller portion. The opening larger portion is of such dimension in relationship to the dimension of the electric switch body to permit the electric switch body to be inserted through the opening large portion, actuator first. The switch body includes a smaller dimension and a ledge or shoulder is located between the switch body larger and smaller dimensions. Upon inserting the switch body through the large dimension, which also accommodates the shoulders, the switch body may be laterally moved into the opening smaller dimension toward the lower panel rear region with the switch body shoulders being located above the lower panel opening. The smaller dimension portion of the opening permits the switch body shoulders to overlie the edges of the smaller dimension opening preventing the switch body from being pushed through the lower panel, and small stop shoulders defined in the neck of the opening small dimension cooperate with the configuration of the switch body to prevent lateral movement of the switch body toward the opening large dimension during vehicle use.

Accordingly, the switch may be quickly installed within the lower panel opening by aligning the switch body and its shoulders with the opening larger portion and pushing the switch therethrough, laterally displacing the switch body over the opening smaller dimension, and lowering the switch into the opening smaller dimension permitting the switch body shoulders to rest upon the upper surface of the seat lower panel. Removal of the switch from the seat lower panel requires the reverse procedure of that previously described.

Excessive pressure upon the switch actuator is prevented by bosses defined in the seat lower panel extending upwardly from the seat panel upper side which will be engaged by the switch actuator plate to prevent excessive depression of the actuator plate.

The vehicle seat safety system of the invention provides an economical manner for mounting an electric switch directly within a seat lower panel, permitting the switch to be installed, or removed, from the seat lower panel quickly and without harm or disassembly to the cushioned portion of the seat. Further, by the utilization of the actuator plate lateral extensions, the electric switch will sense the operator's weight even though such weight has been laterally displaced on the seat due to turning, the operator leaning laterally, or otherwise shifting his weight.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
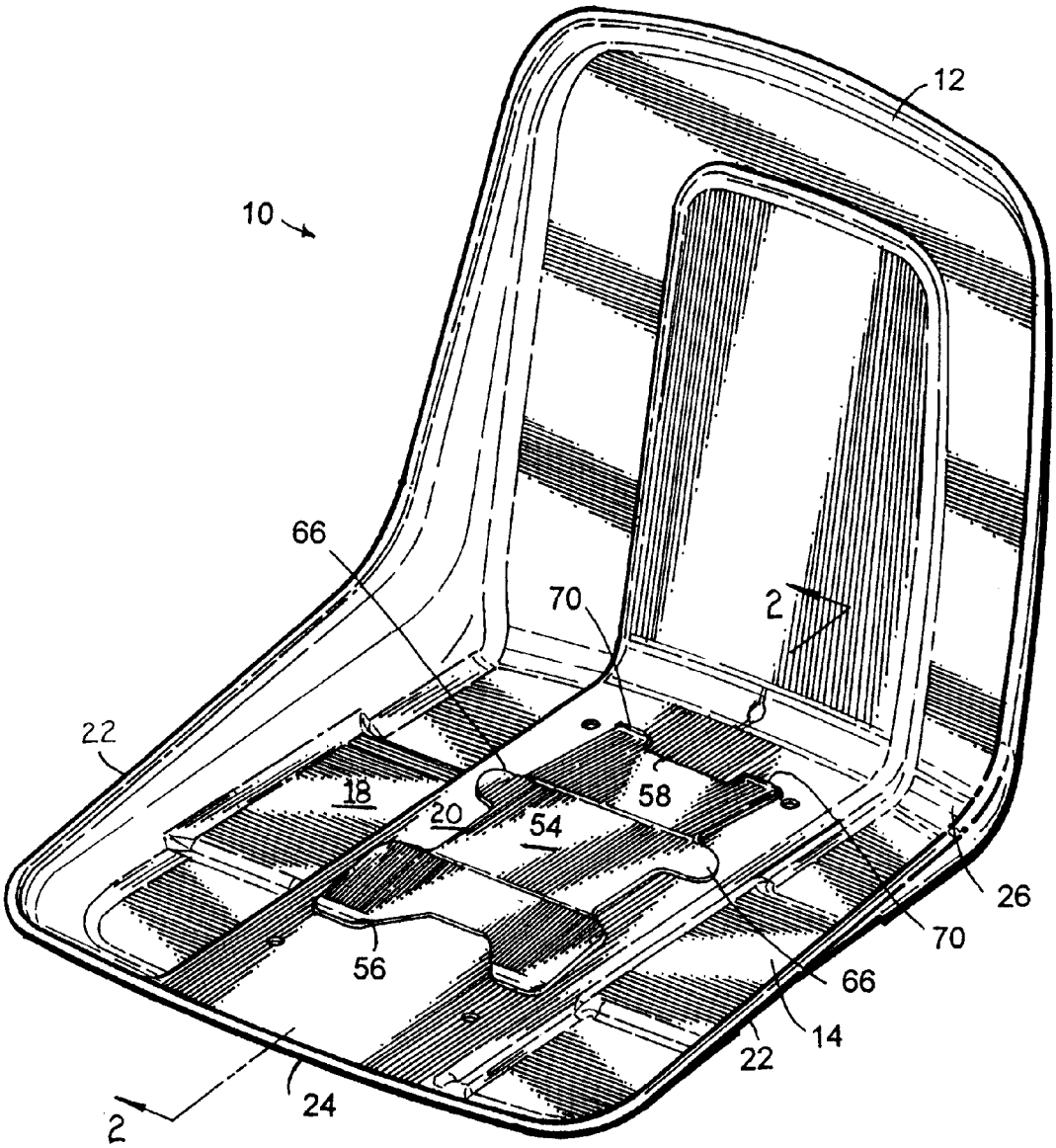
FIG. 1 is a perspective view of a seat pan utilizing the invention, such seat employing a back rest, and the seat cushion being omitted for clarity of illustration.

With reference to FIG. 1, a typical seat pan is shown at 10 of the type that is commonly used with tractors, garden tractors, fork lift trucks and other agricultural or industrial equipment. The seat pan may be pressed of steel, which is the usual case, or could be molded of a rigid synthetic material. In FIG. 1, the illustrated seat pan 10 includes a back panel 12 and a bottom or lower panel 14. A cushion, usually of compressible foam, will be placed upon the back and bottom panels in the known manner to provide a comfortable seat, but for purpose of illustration of this cushion in FIG. 1 is omitted.

The lower panel 14 includes an upper side 16, a lower side 18, a central region 20, lateral sides 22, and a forward region 24 and a rear region 26 located adjacent the back panel 12.

Figure 5:
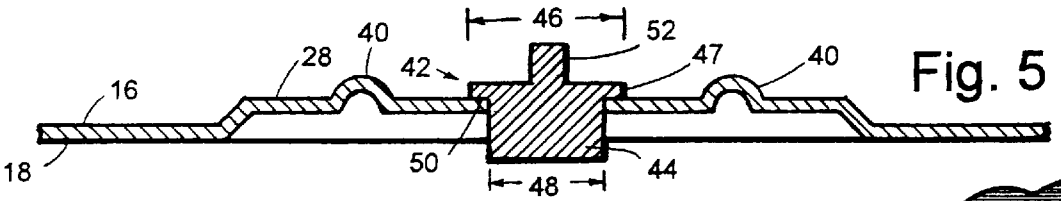
FIG. 5 is a detail elevational view of the central region of the seat lower panel with the electric switch in place, and the actuator plate being omitted for purpose of illustration as taken along Section 5—5 of FIG. 3.
Figure 3:
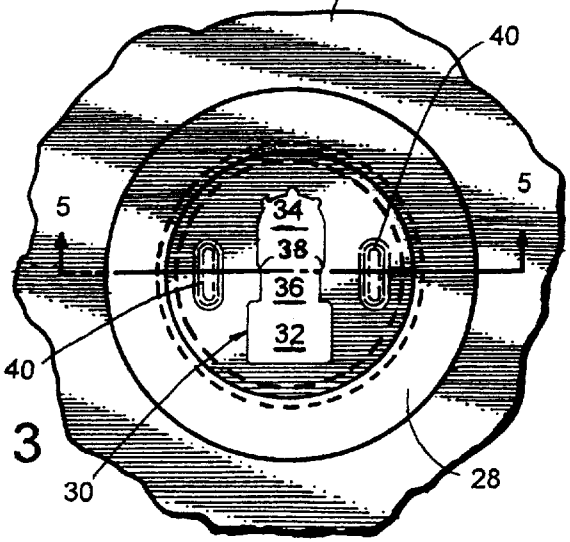
FIG. 3 is a detail plan view of the upper side of the seat lower panel, the electric switch being removed from the lower panel opening for purpose of better illustrating the configuration of the opening.

At its central region 20, an upwardly extending circular boss 28 is defined in the lower panel 14, FIG. 5, and an opening 30 is centrally defined within the boss 28 having a configuration as will be appreciated from FIG. 3.

The opening 30 is of a "keyhole" configuration in that the opening includes a large rectangular portion 32 intersected by a smaller dimensioned portion 34 which includes a reduced dimension neck 36 whereby shoulders 38 are defined between the neck 36 and the small portion 34.

Upon each lateral side of the opening 30, a pair of stop protrusions 40 are defined on the boss 28 as best illustrated in FIG. 5. It will be noted that the protrusions 40 extend upwardly from the seat panel upper side 16.

The electric switch which controls the vehicle component which provides the seat safety function is generally indicated at 42. The switch 42 includes a switch body 44 of a general rectangular configuration which has an upper maximum dimension 46 defined by flanges 47 and a reduced or minimum dimension 48, FIG. 5, which is slightly less than the width of the opening small portion 34, but greater than the width of the opening neck 36. A shoulder 50 is defined between the flanges 47 and the minimum switch body dimension 48 as will be appreciated from FIG. 5.

From the above description of the relative dimensions of the opening 30 and the switch body 44, it will be appreciated that the switch 42 may be inserted into the opening 30 from the lower side 18 of the lower panel 14. This insertion of the switch into the opening 30 is accomplished by inserting the switch body 44 into the opening large portion 32 with the switch actuator 52 being inserted first. Upon the switch body 44 being fully inserted into the opening portion 32, the switch body may then be laterally moved over the neck 36 until the switch body is in alignment above the opening small portion 34. Thereupon, the switch body portion 48 may be pulled downwardly into the opening portion 34 to the position shown in FIGS. 2 and 5. Because the switch body dimension 48 is greater than the opening neck 36, it is not possible to move the switch body back toward the opening large portion 32 because of the shoulders 38, and the switch 42 will be positively retained in the proper location within opening 30. From the above description, it will be appreciated that the switch 42 may be removed from the opening 30 by reversing the above described procedure. Further, it will be appreciated that as the installation of the switch 42 onto the lower panel 14 completely takes place from the lower panel lower side, installation and removal of the switch 42 does not interfere with the seat cushion or superstructure.

The switch 42 is operated by an upwardly spring biased actuator generally indicated at 52. The actuator 52 is operated by an actuator plate 54 having a configuration which will be appreciated from FIGS. 2 and 4. The actuator plate 54 includes a front edge 56 of a paddle-type shape, a rear edge 58, lateral edges 60 and a central region 62. As will be appreciated from FIG. 2, the actuator plate 54 bows upwardly away from the panel upper side 16 between the front and rear edges 56 and 58, respectively. The actuator plate 54 is formed of a high strength resilient material, such as spring steel, or the like, so as to maintain its "relaxed" position as shown in FIG. 2 wherein the central region 62 will be superimposed over the switch actuator 52.

Figure 4:
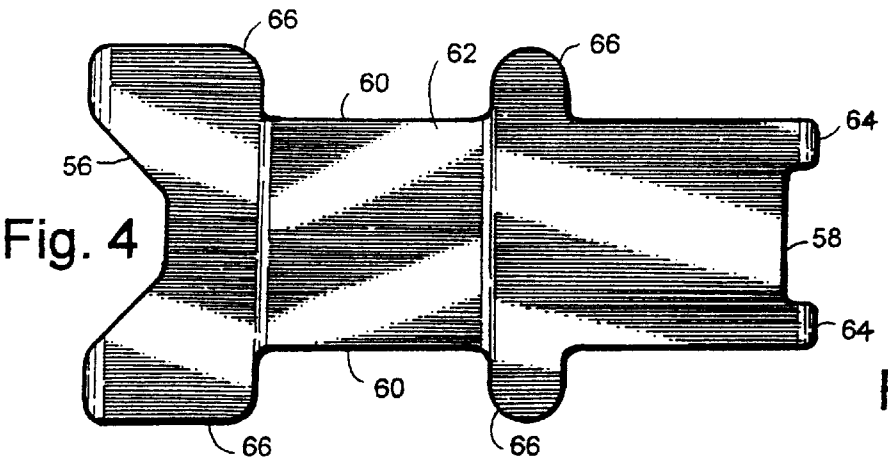
FIG. 4 is a plan elevational view of the electric switch actuator plate, per se.

The actuator plate rear edge 58 includes a pair of rearwardly extending hinge tabs 64, FIG. 4, which extend in the longitudinal direction of the elongated actuator plate, and lateral extensions 66 are defined upon the actuator plate at its central region for a purpose later described, and extensions 66 are also formed on end 56.

Figure 2:
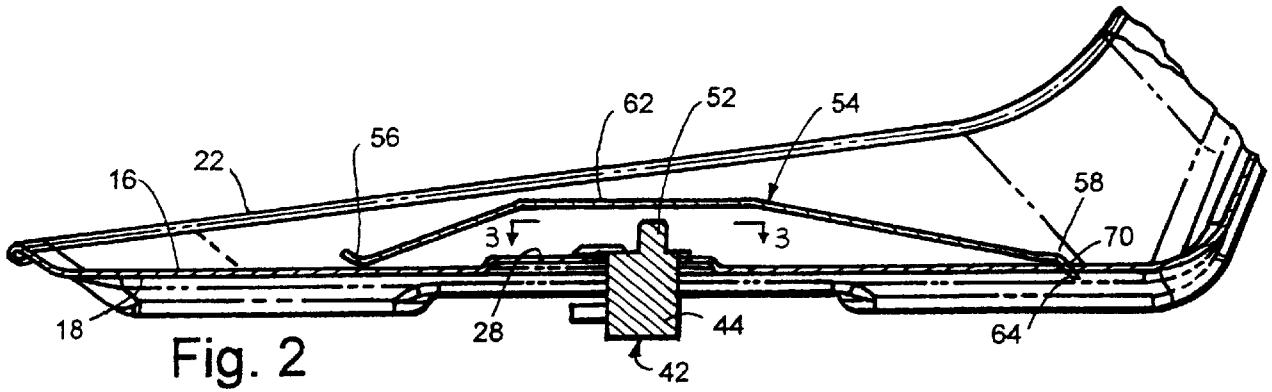
FIG. 2 is an elevational sectional view of the seat pan of FIG. 1 as taken along Section 2—2 thereof.

A pair of hinge holes 70 extend through the lower panel 14 adjacent the rear region 26 as will be appreciated from FIGS. 1 and 2. The actuator plate hinge tabs 64 are received within the hinge holes 70, FIG. 1.

When assembling the seat pan 10, the actuator plate 54 will be assembled to the lower panel upper side 16 by inserting the hinge tabs 64 into the hinge holes 70. If desired, the switch 42 may be inserted into the opening 30 prior to assembling the actuator plate to the lower panel. However, it will be appreciated that the time at which the switch 42 is inserted into the opening 30 is optional as the switch 42 may be inserted into the opening 30, or removed therefrom, at any time.

After the actuator plate 54 is properly located on the lower panel upper side 16 with its tabs 64 within the hinge holes 70, the cushion, not shown, may be mounted upon the upper side of the seat pan 10 in the conventional manner, and the spring resiliency of the actuator plate 54 constitutes biasing means sufficient to prevent the cushion from depressing the actuator plate into engagement with the switch actuator 52 so that the relationship shown in FIG. 2 between the actuator plate 54 and the switch 42 exists even though the foam is mounted upon the seat pan. Also, the switch actuator 52 will be biased upwardly by an internal spring. Preferably, the bottom of the cushion, not shown, is recessed directly above the actuator plate 54 in a configuration corresponding to that of the actuator plate, and this recessing of the cushion will insure that no force is applied to the actuator plate until the operator sits on the seat cushion. The recessing of the cushion helps to insure that the cushion does not settle and apply force to the actuator plate when the operator is not in the seat, and this recessing of the seat cushion insures that the switching mechanism will operate in the desired manner.

When an operator sits upon the seat cushion, not shown, the operator's weight will depress the actuator plate 54 downwardly into engagement with the switch actuator 52, depressing the switch actuator 52 to either open or close switch 42, depending on the type of switch utilized. In this manner, the switch 42 will control the desired safety function component of the vehicle, for instance, permit the engine to be started, permit a power takeoff to be engaged, or control other functions.

Regardless of the weight of the operator, the actuator plate 54 will not be depressed excessively as to possibly damage the switch 42 in that the actuator plate will engage the stop protrusions 40 preventing further depression of the switch actuator and possible damage to the switch.

During the operation of a vehicle, it is not uncommon for the operator's weight upon the seat to laterally shift, such as when turning, traversing a hill, or leaning laterally to obtain better vision. In such instances, the operator is properly seated and the operation of the vehicle must be normal. The presence of the lateral extensions 66 permits enough of the operator's weight, even when displaced laterally, to be applied to the actuator plate 54 to depress the switch actuator 52 in order to maintain normal vehicle operation. Further, the width of the actuator plate front edge is such as to accommodate this lateral force imposed on the actuator plate, and as the rearmost lateral extensions 66 are substantially in a transverse line with the switch 42, the hinging of the actuator plate, and the pressure applied to the actuator plate by the extensions 66 insures normal vehicle operation under all safe operating conditions.

From the above description, it will be appreciated that the invention permits economical structure to be utilized with a vehicle seat safety system which is dependable in operation, rugged in use, and permits the electric switch to be assembled or removed from the seat without requiring seat disassembly.

It is appreciated that various modifications to the inventive concepts may be apparent to those skilled in the art without departing from the spirit and scope of the invention.

What is claimed is:

1. A vehicle seat safety system for a seat having a lower panel having upper and lower sides, a central region, lateral sides, a forward region and a rear region, said panel adapted to support a flexible cushion, the improvement comprising an opening defined in the lower panel central region, a vehicle control electrical switch mounted in said opening, said switch including an actuator vertically movable between switch open and closed positions extending from the lower panel upper side, a vertically movable actuator plate located below the cushion and extending over said switch actuator for selective engagement therewith for moving said actuator between its open and closed positions upon the application and removal of weight upon said actuator plate, said actuator plate being of an elongated configuration having front and rear edges, lateral sides and a central region, said actuator plate front edge, rear edge and lateral sides extending toward the seat lower panel forward region, rear region and lateral sides, respectively, said actuator plate including extensions defined on its lateral sides extending therefrom for applying weight to said actuator plate even though the seat occupant's weight is laterally shifted, a hinge defined on an actuator plate edge operatively connected to the seat lower panel, and biasing means biasing said actuator plate away from said switch actuator.

2. In a vehicle seat safety system as in claim 1, said hinge comprising a pair of spaced tabs extending from said actuator plate rear edge, and a pair of openings defined in the seat lower panel receiving said tabs.

3. In a vehicle safety seat system as in claim 1, said actuator plate being formed of a resilient material having a bowed configuration whereby said actuator plate bows upwardly away from the lower panel upper side and said switch actuator.

4. In a vehicle seat safety system as in claim 3, said actuator plate being formed of spring steel.

5. In a vehicle seat safety system as in claim 1, upwardly extending projections defined on the lower panel upper side below said actuator plate limiting downward movement of said actuator plate to prevent damage to said switch.

6. A vehicle seat safety system for a seat having a lower panel having upper and lower sides, a central region, lateral sides, a forward region and a rear region, said panel adapted to support a flexible cushion, the improvement comprising an opening defined in the lower panel central region a vehicle control electrical switch mounted in said opening, said switch including an actuator vertically movable between switch open and closed positions extending from the lower panel upper side, a vertically movable actuator plate located below the cushion and extending over said switch actuator for selective engagement therewith for moving said actuator between its open and closed positions upon the application and removal of weight upon said actuator plate and biasing means biasing said actuator plate away from said switch actuator, said switch having a body including a maximum horizontal dimension and a reduced horizontal dimension and a horizontal shoulder defined between said dimensions, the opening defined in the lower panel central region being of a keyhole configuration having a large dimension slightly greater than said switch body maximum dimension and a small dimension less than said switch body maximum dimension and greater than said switch body reduced dimension whereby said switch may be inserted into said lower panel opening from the lower panel lower side by first inserting the switch body maximum dimension through said opening large dimension and lateral displacement of said switch body until said switch body reduced dimension is in vertical alignment with said opening small dimension permits said switch body to be lowered into said opening small dimension with said shoulder overlying the lower panel upper side to affix said switch body in the lower panel opening.

7. In a vehicle seat safety system as in claim 6, said opening including a neck between said opening large dimension and said opening small dimension of a dimension less than that of switch body reduced dimension to prevent lateral displacement of said switch body toward said opening large dimension.

* * * * *